United States Patent [19]

Ehrenberger

[11] 4,131,776

[45] Dec. 26, 1978

[54] MOTORIZED DRIVE ASSEMBLY FOR A CIRCUIT BREAKER OPERATOR

[75] Inventor: Frank T. Ehrenberger, Iowa City, Iowa

[73] Assignee: Square D Company, Park Ridge, Ill.

[21] Appl. No.: 732,242

[22] Filed: Oct. 14, 1976

[51] Int. Cl.[2] ..... H01B 3/40

[52] U.S. Cl. ..... 200/158; 74/25; 74/89.15; 74/405

[58] Field of Search ..... 200/158; 74/25, 89.15, 74/405

[56] References Cited

U.S. PATENT DOCUMENTS

| | | | |
|---|---|---|---|
| 1,134,358 | 4/1915 | Eyck | 74/405 |
| 1,685,306 | 9/1928 | Armstrong | 74/405 |
| 1,982,339 | 11/1934 | Ehrenfeld | 200/158 X |
| 2,036,305 | 4/1936 | Snyder | 200/158 |
| 2,495,689 | 1/1950 | Bracke et al. | 74/405 |
| 2,870,288 | 1/1959 | Schmidt | 200/158 |
| 3,056,874 | 10/1962 | Gough, Jr. | 200/158 |
| 4,022,076 | 5/1977 | Metz | 74/89.15 |

*Primary Examiner*—Harold J. Tudor

*Attorney, Agent, or Firm*—Norton Lesser; Richard T. Guttman

[57] ABSTRACT

A motorized drive assembly for a circuit breaker operator comprising a follower mounted on a free wheeling double helix shaft which extends in the direction of movement of the operator between "TRIP," "RESET" and "ON" positions, the shaft being driven by an electric motor through a disengageable gearset controlled by a solenoid. The follower engages the operator, and upon rotation of the shaft the follower moves in one direction carrying the operator from a TRIP position to a RESET position. At this point, the follower has moved as far as one of the double helices will carry it in that direction, whereupon internally projecting lugs of the follower engage the other helix for movement in the opposite direction to carry the operator from the RESET to the ON position in which the breaker contacts are closed. The solenoid is then de-energized whereupon the gearset disengages, and the double helix shaft becomes free-wheeling which allows the follower to move freely when the circuit breaker trips causing the operator to move from the ON position to the TRIP position.

5 Claims, 5 Drawing Figures

MOTORIZED DRIVE ASSEMBLY FOR A CIRCUIT BREAKER OPERATOR

BACKGROUND OF THE INVENTION

This invention relates to the field of motor driven devices which move the operators of circuit breakers between the TRIP, RESET or OFF and ON positions. Since the operator in conventional circuit breakers moves in two opposite directions to the RESET and then to the ON positions, some type of direction changing mechanism is required. Prior art devices of this kind have used reverse gear assemblies or reverse motor drives, which are complex, expensive and more susceptible to breakdown, damage and wear than a more simplified drive mechanism would be. Furthermore, it is desired that the drive mechanism allow free movement of the operator after it has been moved from the RESET to the ON position, so it may freely move from the ON to the TRIP position when the circuit breaker trips.

The drive assembly in accordance with this invention does not require a reverse gear assembly or a reverse motor drive.

SUMMARY OF THE INVENTION

It is an object of the invention to provide a motorized drive assembly for a circuit breaker operator which includes a single direction motor and operating shaft, a follower mounted on said shaft for axial movement thereon in two opposite directions while said shaft is rotated in a single direction, to move a circuit breaker operator connected to said follower from the TRIP position to the RESET position in one direction and from the RESET position to the ON position in the opposite direction.

It is an object of the invention to provide a motorized drive assembly for a circuit breaker operator which includes a single direction motor and operating shaft, wherein said shaft includes double helix groove means thereon and a follower mounted on said shaft having internally projecting lugs seated in said groove means for axial movement along said shaft in alternately opposite directions as said shaft is rotated in a single direction.

It is an object of the invention to provide a motorized drive assembly for a circuit breaker operator, including a disengageable gearset, and a coil to control engagement and disengagement of said gearset.

It is an object of the invention to provide a motorized drive assembly for a circuit breaker operator, in which the drive assembly becomes free-wheeling after the operator has been moved from the RESET to the ON position.

DESCRIPTION OF PREFERRED EMBODIMENT

Figure 1:
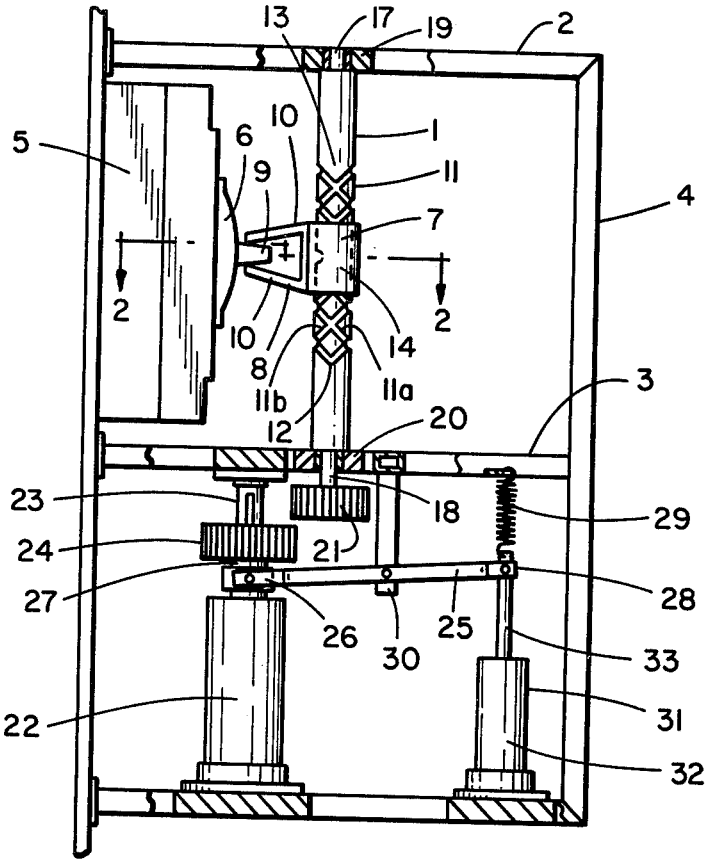
FIG. 1 is a side elevation view of a motorized drive assembly connected to a circuit breaker operator in accordance with this invention, showing the operator and follower in the TRIP position and the gear set disengaged.
Figure 2:
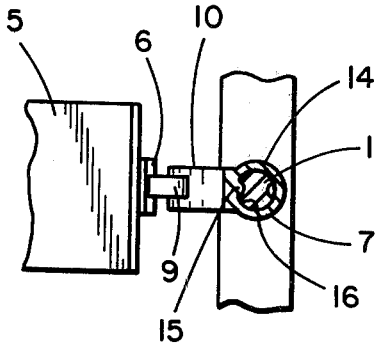
FIG. 2 is a section taken on line 2—2 of FIG. 1.

A cylindrical drive or follower shaft 1 is mounted for rotation between upper support member 2 and lower support member 3 of a frame 4, and positioned facing circuit breaker 5 and case 6.

A follower 7 is mounted on the drive shaft 1 in engagement with operator 6 by means of a forked member 8 which receives the handle 9 case 6 between the fingers 10 of forked member 8.

The drive shaft 1 has a double helix formed therein comprising a continuous double helix groove 11 which extends first in one direction of rotation around shaft 1 from a first groove end region 12 at a lower portion of shaft 1 to a second groove end region 13 at an upper portion of the shaft, whereupon the continuous groove 11 curves partially around shaft 1 at end region 13 and then extends helically in the same direction of rotation but in the opposite axial direction, namely from the second groove end region 13 to the first groove end region 12. The groove 11 curves partially around shaft 1 at groove end region 12 and joins the first described portion of the continuous groove 11 which extends from the first groove end region 12 to the second groove end region 13.

The result of such groove structure is to provide one grooved helical path **11*a* which winds in one direction of rotation as it extends from the first groove end region 12 to the second groove end region 13, and a second grooved helical path 11*b* which winds in the opposite direction of rotation as it extends from the same first groove end region 12 to the second groove end region 13**.

The follower 7 includes a cylindrical body 14 having a central bore through which the drive shaft 1 extends. It also includes an inwardly projecting lug 15 extending from the inner wall 16 of cylindrical body 14 and into the continuous double helix groove 11. Thus, as the drive shaft 1 is rotated, and the follower 7 held against rotation, the lug 15 is cammed by the incline of helical groove 11 causing it and follower 7 to move axially along the shaft 1 until it reaches the groove end region or reversing juncture 12 or 13 toward which it is headed. Thereupon, while the shaft continues rotating in the same direction of rotation the lug 15 follows groove 11 as it curves partially around shaft 1 at such end region and begins to extend in the opposite axial direction toward the opposite groove end region. Thus, follower 7 is caused to move in the opposite axial direction even though shaft 1 is still rotated in the same direction of rotation. Such axial movement of follower 7 continues until the said opposite groove end region is reached, whereupon the same process occurs and follower 7 again changes axial direction by reason of its lug 15 being continuously cammed by the continuous double helix groove 11 as the drive shaft 1 is rotated in a single direction of rotation.

The drive shaft 1 includes axles 17 and 18 which are journaled in respective bearings 19 and 20 mounted in upper support member 2 and lower support member 3 respectively. Axle 18 extends through its bearing 20 and projects outwardly to receive a spur gear 21 which is fixedly mounted thereon to rotate the double helix drive shaft 1.

An electric motor 22 is mounted on the frame 4 with its drive or unidirectional motor shaft 23 extending toward, and parallel to but offset from, the double helix drive shaft 1. A drive gear 24 is keyed on the motor drive shaft 23 for limited axial movement thereon between an engaged position, wherein drive gear 24 meshes with spur gear 21 to rotate the double helix drive shaft 1, and a disengaged position, wherein drive gear 24 is disengaged from spur gear 21.

A shift lever 25 is provided having a forked end 26 bearing against side 27 of drive gear 24, and a powered end 28 being biased by a spring 29 towards a normally disengaged position. The shift lever 25 is pivoted at an intermediate point on pivot post 30 which is fixedly mounted on the frame 4.

A solenoid 31, comprising coil 32 and armature 33, is mounted on the frame 4 with armature 33 connected to the end 28 of shift lever 25 for movement thereof toward an engaged position of drive gear 24 with spur gear 21 when the coil 32 is energized by an appropriate power source (not shown).

The above-described drive assembly operates as follows. Beginning with the circuit breaker operator 6 in a TRIP position, as shown in FIG. 1, the follower 7 is approximately at mid-point on the double-helix drive shaft 1 between groove end region 12 and groove end region 13. To move the operator 6 to its RESET position, power is supplied to electric motor 22 to rotate drive gear 24. Coil 32 is then energized, causing armature 33 to move inwardly thereof and moving end 28 of shift lever 25 against the bias of spring 29. The opposite forked end 26 of shift lever 25 bears against side 27 of the drive gear 24 causing it to mesh with spur gear 21 and begin rotation of the double helix drive shaft 1 in a single pre-determined direction of rotation. Assume that the pre-determined direction of rotation is such that it will first move follower 7 upwardly from the TRIP position as viewed in FIG. 1, and that operator 6 will be in its RESET position when its handle 9 is in the uppermost position as shown in FIG. 3.

Figure 3:
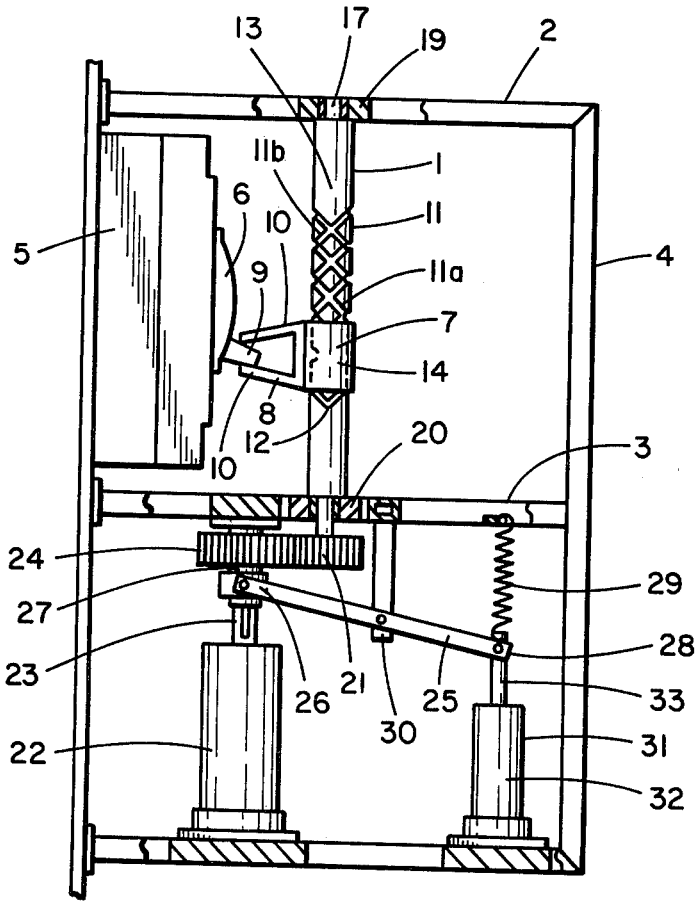
FIG. 3 is a side elevation view of the drive assembly of FIG. 1 showing the operator and follower in the RESET position and the gearset engaged.
Figure 4:
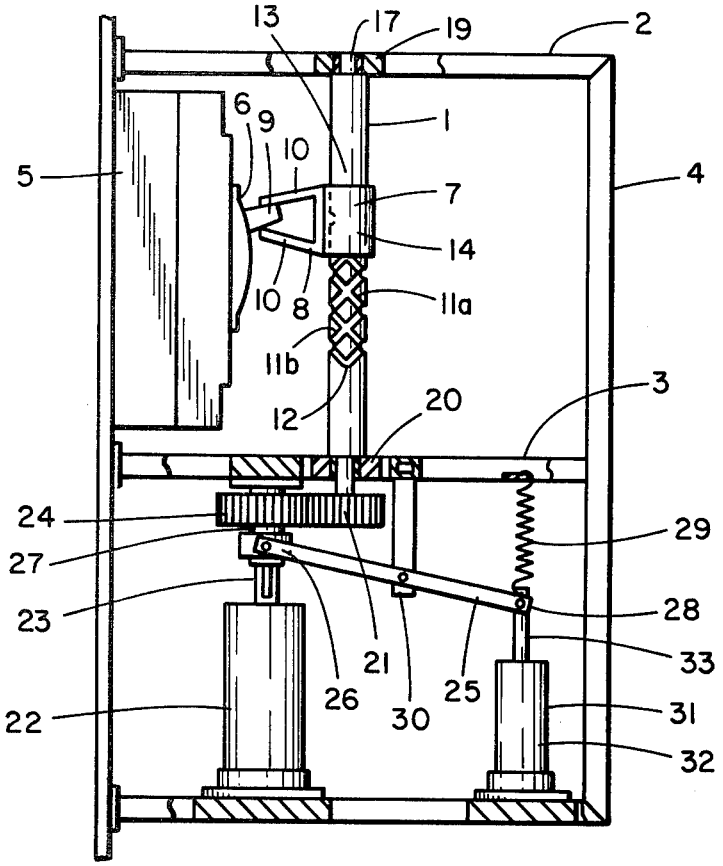
FIG. 4 is a side elevation view of the drive assembly of FIG. 1 showing the operator and follower in the ON position and the gearset engaged.

Thus, as the gears 21 and 24 mesh and the double helix drive shaft begins to rotate, follower 7 begins to move in the upward axial direction from the position shown in FIG. 1 to the position shown in FIG. 3. The operator 6 is accordingly moved by follower 7 to its RESET position. At this point, lug 15 of follower 7 riding in continuous double-helix groove 11 has reached the groove end region 13 whereupon it ceases to be cammed in an upwardly axial direction and now begins to be cammed downwardly causing follower 7 to move in the opposite axial direction toward the position shown in FIG. 4. As the follower 7 moves to the opposite groove end region 12 it moves the operator 6 from the RESET to the ON position, at which time the coil 32 is de-engerized enabling the spring 29 to move the shift lever to the disengaged position allowing drive gear 24 to disengage from spur gear 21.

Figure 5:
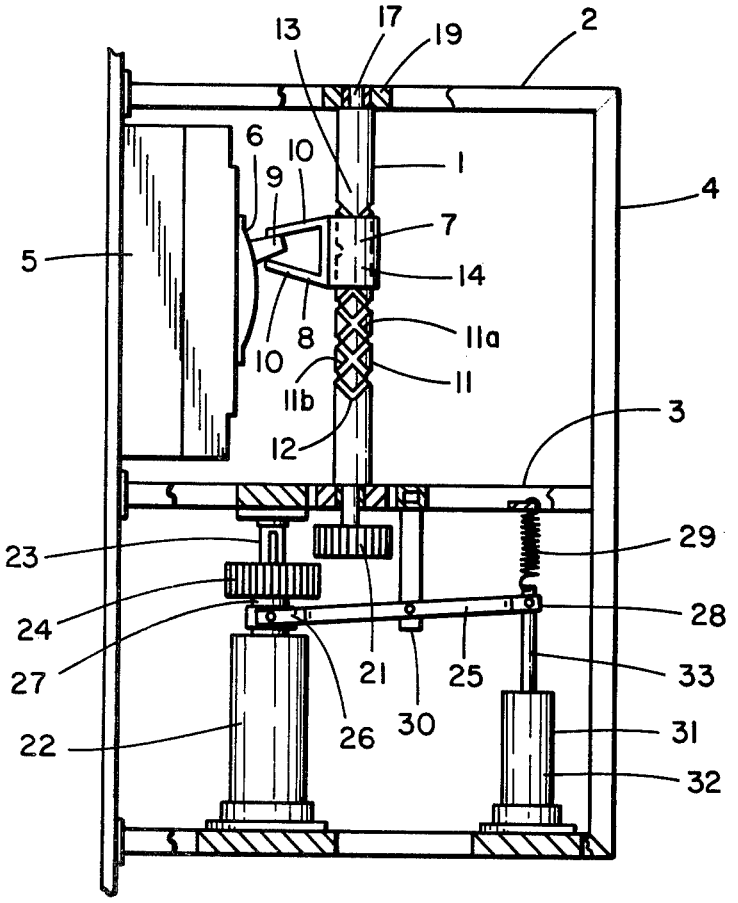
FIG. 5 is a side elevation view of the drive assembly showing the operator and follower in the ON position as in FIG. 4 but with the gearset disengaged.

The double-helix shaft 1 is thereupon free to rotate and the follower 7 is free to move axially from the ON position as shown in FIG. 5 to the TRIP position as shown in FIG. 1 when the circuit breaker trips.

The follower 7 provides a convenient and useful visual trip indicator in accordance with this invention, whereby one can determine at a glance when a circuit breaker operator is in the TRIP position. At such time, the follower 7 will be approximately midway between the first or lower groove end region 12 and the second or upper groove end region 13 of the double-helix shaft 1.

I claim:

1. A motor driven assembly in combination with a circuit breaker adapted to interrupt a circuit in response to a fault condition in said circuit and having an operator handle with opposing faces pivotable in one direction about one axis from an ON position to a TRIP position in response to a fault condition and pivotable in said one direction from said Trip position to a Reset position whereafter said operator is pivotable in the opposite direction from said Reset position to said ON position to enable restoration of said circuit, comprising:

a motor having a motor shaft rotatable in only one direction about a second axis transverse to said one axis, a follower shaft rotatable independently of said motor shaft about a third axis parallel to said second axis and having a pair of oppositely wound axially extending intersecting helical grooves formed in the surface of said follower shaft with said grooves having a reversing juncture at opposite ends of each groove, follower means rotatably mounted on said follower shaft and coupled with one of said grooves to move in a respective axial direction of said third axis in response to rotation of said follower shaft in one direction and thereafter coupled with the other groove at one housing juncture to move in the opposite axial direction of said third axis in response to rotation of said follower shaft in said one direction whereafter said follower means is coupled with said one groove by the other reversing juncture, means extending from said follower means radially of said first axis and transversely to the axis of said follower shaft engaging each face of said operator handle to move said follower in said one direction for rotating said follower shaft in response to pivoting of said operator handle from said ON position to said TRIP position and thereafter operable to pivot said operator handle from said TRIP position to said RESET position in response to movement of said follower means in said respective axial direction of said third axis and to thereafter pivot said operator handle from said RESET position to said ON position in response to movement of said follower means in the opposite axial direction of said third axis with said operator handle moving radially relative said third axis, a first gear rotatable with one of said shafts and movable axially of said one shaft in selected directions, a second gear rotatable with the other of said shafts and adapted to engage said first gear to rotate with said first gear in response to a selected axial movement of said first gear to engage said second gear, and electrically operable means to move said first gear axially of said one shaft to engage said gears for moving said follower and operator handle in response to rotation of said motor shaft.

2. A motor driven assembly as set forth in claim 1, wherein said follower means includes a cylindrical body having a central bore therein, said cylindrical body encircling said follower shaft, and a lug on said cylindrical body projecting inwardly of said central bore, said lug being received in each of said helical grooves to move said follower means in both axial directions of said follower shaft as said follower shaft is rotated in a respective direction.

3. A motor driven assembly as set forth in claim 2 wherein said follower means includes a pair of spaced fingers extending transverse the axis of said follower shaft and engaging a respective opposite face of said operator handle to enable pivotal movement of said operator handle from a TRIP position to a RESET position and from a RESET position to an ON position.

4. A motor driven assembly as set forth in claim 1, wherein said electrically operable means includes a shift lever connected to move said first gear on said motor drive shaft to a drive-engaged position, an electrical coil, and armature associated with said coil and mounted for movement between a first position in response to energization of said coil and a second position in response to denergization of said coil, said armature being connected to said shift lever to move said first gear to said drive engaged position when said armature is in said first position and said coil is energized.

5. A motor driven assembly as set forth in claim 1, wherein each helical groove extends a distance axially of said follower shaft corresponding to the travel distance of said operator handle between its RESET position and its ON position.

* * * * *